United States Patent [19]

Staudt et al.

[11] 4,377,076

[45] Mar. 22, 1983

[54] COOLING ARRANGEMENT, PARTICULARLY FOR BEVERAGES

[75] Inventors: Wilhelm Staudt, Mosbach; Hans-Wido Steier, Esting, both of Fed. Rep. of Germany

[73] Assignee: Electrolux-Sigmund GmbH, Mosbach, Fed. Rep. of Germany

[21] Appl. No.: 238,676

[22] Filed: Feb. 27, 1981

[30] Foreign Application Priority Data

Dec. 24, 1980 [DE] Fed. Rep. of Germany ..... 3048967

[51] Int. Cl.[3] ..... B65D 5/62

[52] U.S. Cl. ..... 62/395; 62/434; 62/457

[58] Field of Search ..... 62/451, 457, 430, 434, 62/438, 448, 449, 393–395, 439

[56] References Cited

U.S. PATENT DOCUMENTS

| | | | |
|---|---|---|---|
| 2,083,396 | 6/1937 | Philipp | 62/438 X |
| 2,219,789 | 10/1940 | Potter | 62/430 X |
| 2,466,460 | 4/1949 | Marshall | 62/434 X |
| 2,509,779 | 5/1950 | Morrison | 62/448 X |
| 2,538,015 | 1/1951 | Kleist | 62/430 X |
| 2,721,454 | 10/1955 | Levey | 62/449 X |
| 2,726,658 | 12/1955 | Chessey | 62/434 X |
| 3,120,742 | 2/1964 | Denisoff | 62/434 |
| 3,156,101 | 11/1964 | McGuffey | 62/434 X |
| 3,280,586 | 10/1966 | Funakoshi | 62/457 X |
| 3,605,431 | 9/1971 | Carson | 62/457 X |
| 3,747,364 | 7/1973 | Laing | 62/434 X |
| 4,103,510 | 8/1978 | Hall | 62/457 X |

FOREIGN PATENT DOCUMENTS

| | | | |
|---|---|---|---|
| 1427938 | 3/1976 | United Kingdom | 62/395 |

*Primary Examiner*—Lloyd L. King

*Attorney, Agent, or Firm*—Kontler, Grimes & Battersby

[57] ABSTRACT

A vessel for the storage of cooled liquids, particularly beverages, is surrounded by a thermally insulating jacket. First and second cooling coils or analogous devices are interposed between the vessel and the jacket and surround the vessel from opposite sides of the same over 50–75% of its surface area. Water refrigerated to about 0° C. is circulated through these cooling coils.

2 Claims, 5 Drawing Figures

FIG.1
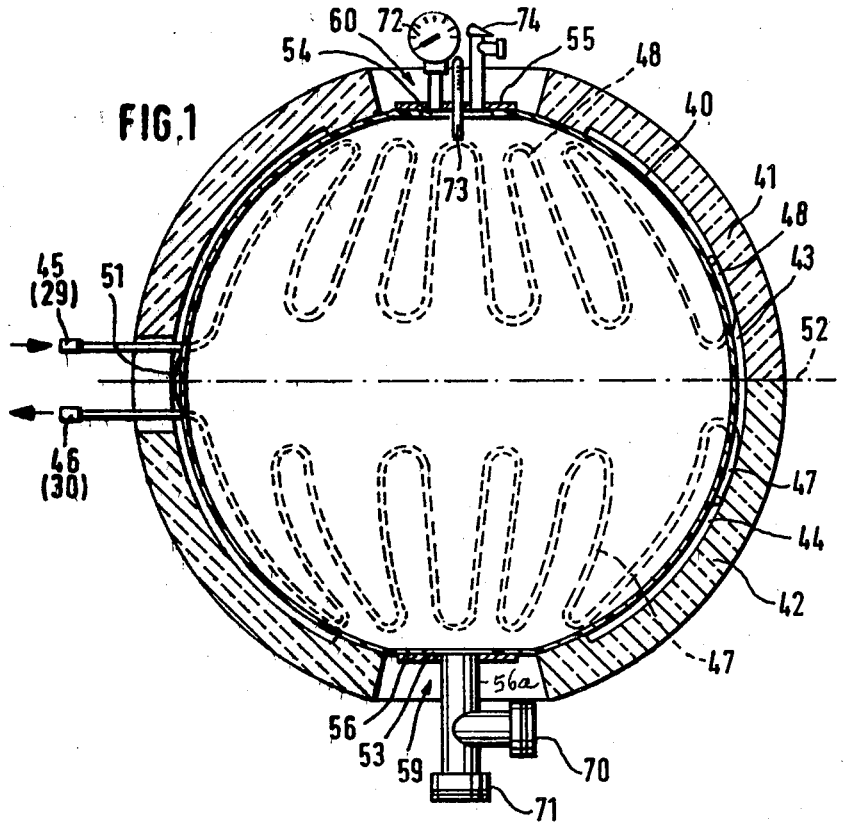
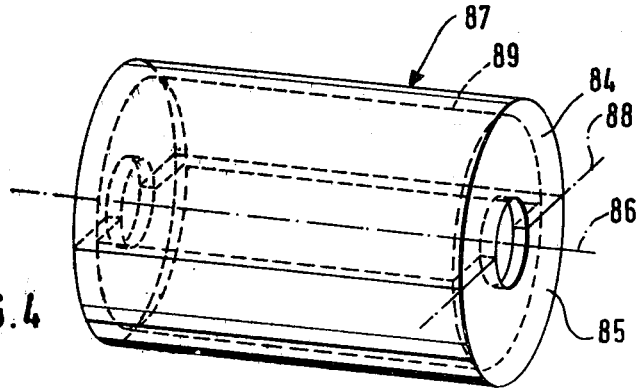
FIG.4

COOLING ARRANGEMENT, PARTICULARLY FOR BEVERAGES

BACKGROUND OF THE INVENTION

This invention relates to coolers in general, and more particularly to a cooling arrangement which is especially suited for the cooling of beverages.

Many beverages, including beer, wine, soft drinks, milk and the like, either need to be stored at cool temperatures to avoid spoilage (e.g., milk) or are stored under such circumstances because of consumer preferences. Depending upon the type of beverage, storage usually takes place at a temperature in the range of about 4°-10° C. it is desirable to maintain the beverage as close as possible to the optimum temperature and to avoid temperature fluctuations. In addition the formation of temperature gradients within the storage vessel should be avoided. The prior art has not been able to satisfactorily meet these requirements.

OBJECTS AND SUMMARY OF THE INVENTION

An object of the invention is to provide a novel and improved cooling arrangement which permits liquids (especially but not necessarily beverages) to be maintained at a selected uniform temperature while in storage.

Another object of the invention is to provide an arrangement which not only permits a liquid to be kept at a selected temperature but which avoids or at least sharply reduces temperature fluctuations.

A further object of the invention is to provide an arrangement which avoids the formation of temperature gradients in a body of cooled stored liquid.

The invention resides in a device for cooling of stored liquids, particularly beverages. The device comprises a vessel (e.g., a spherical or cylindrical vessel which may or may not constitute a pressure vessel) for the liquid to be stored and a thermally insulating jacket surrounding the vessel and in contact therewith. The jacket could conceivably be of one piece, but preferably comprises two facing shell sections which confine the vessel.

First and second cooling means (e.g., cooling coils of copper or other tubing) surround the vessel within the insulating jacket. The insulating jacket confines the vessel from opposite sides over 50–75% of the vessel surface area; 67% has been found to be particularly advantageous. A supply arrangement, including a refrigeration system, passes cooled water ("ice water") through the cooling means to cool the liquid in the vessel.

If the insulating jacket has two facing shell sections which meet in a parting plane or engaging plane, the inlet and outlet conduits which are connected to the cooling means are preferably located in or close to the parting plane where they extend outwardly through the jacket.

The novel features which are considered as characteristic of the invention are set forth in particular in the appended claims. The improved cooling arrangement itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a vertical sectional view of a first embodiment of the invention;

FIG. 4 is a perspective view of a cylindrical pressure tank for storage of liquid to be maintained in cooled condition.

DESCRIPTION OF THE PREFERRED EMBODIMENTS

Figure 2:
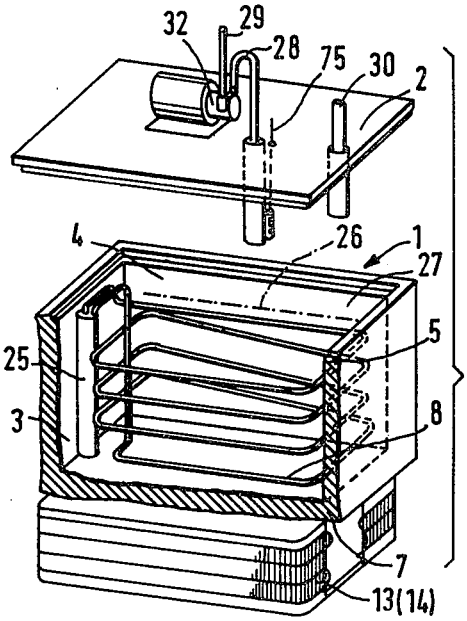
FIG. 2 is an exploded perspective view partly in section, showing a refrigeration system which may be used in conjunction with the embodiment of FIG. 1.

A first embodiment of the invention is illustrated in FIG. 1 where the reference character 40 denotes a spherical pressure tank for storage of a liquid (e.g., a beverage) to be kept cool. The tank 40 may be of any suitable material, for example, a glass-fiber reinforced synthetic plastic substance. For the purposes of this description, it will be assumed that the tank 40 is to be used for the storage of beer, although this is evidently only by way of example. The tank 40 has a lower opening 53 which is closed by a flange or plate 56 and a registering upper opening 54 which is closed by a flange or plate 55.

The flange 56 is connected to a pipe **56*a* which communicates with the interior of the tank 40 and also communicates with an inlet nipple 70 and an outlet nipple 71** (the latter can be blocked and unblocked in a manner known per se, e.g., by means of a valve).

To thermally insulate the tank 40, the latter is surrounded by a spherical insulating jacket which is composed of two facing shells 41 and 42. These shells tightly surround the tank 40 (with certain exceptions which are still to be described) and meet in a horizontal plane 52 where they may be suitably connected to one another, e.g., by bonding. Suitable thermally insulating material for the shells 41, 42 is known per se and, therefore, need not be described in detail. The shells have openings or cutouts 59, 60 for the pipe **56*a* of the flange 56, and for a pressure gauge 72, a thermometer 73 and a pressure relief valve 74, all mounted on the flange 55**.

Located between the tank 40 and the shells 41, 42—and this is the one exception to the aforementioned tight engagement—are coolers 47 and 48. To accommodate these coolers, the inner surfaces of the shells 41, 42 are recessed to form spaces 43, 44 with the outer surface of the tank 40; the coolers 47, 48 are located in these spaces and contact the outer surface of the tank 40. Between the two of them, the coolers 47, 48 overlap a major portion of the tank surface; in the embodiment of FIG. 1, this amounts to 67% of the surface of tank 40, a value which has been found to be particularly advantageous for achieving the purposes of the invention. The areas of the armatures pipe **56*a*, the pressure gauge 72, the thermometer 73 and the pressure relief valve 74, as well as of the plane 52**, are free of this overlap.

Each of the coolers 47, 48 is composed of a cooling coil which is placed on and about the respective portion of the tank surface. A conduit 51 is located between the tank 40 and the shells 41, 42 and connects the coils of the coolers 47, 48 with one another. The free end of the coil of the cooler 48 is connected to an inlet pipe 45 and the free end of the coil of the cooler 47 is connected to an outlet pipe 46. The pipes 45, 46 are located in or close to (FIG. 1) the plane 52 and extend from the jacket 41, 42.

It should be noted that the illustrated construction of the coolers 47, 48 is by way of example only and that other solutions exist. For example, each of the coolers could be made of two water-impermeable synthetic plastic foils which are connected (e.g., HF-welded) to form a flat watertight envelope. The interior of each envelope would then be subdivided (e.g., by further HF-weld seams) to form a labyrinthine flow path for cooling fluid and each of the thus constructed envelopes would be accommodated in one of the spaces 43, 44.

The cooling fluid to be circulated through the coolers 47, 48 is "ice water", i.e., water which is cooled to a temperature just above the freezing point. This effects the desired cooling of the liquid contents of the tank 40. Depending upon the type of liquid in the tank 40 (e.g., beer), the interior of the tank 40 may also be maintained under pressure from carbon dioxide or compressed air; liquid is expelled from the tank by admitting either carbon dioxide or air under pressure while opening the outlet nipple 71.

The anomaly exhibited by water at 4° C. is well known and is also observed in water-based beverages. Due to this fact, differential liquid flows are known to occur within the pressure tank, depending upon whether the liquid is cooled to 4° C. or to a temperature higher than 4° C., for example, 8° C. This would inherently lead to non-uniform cooling and to the development of temperature gradients in the interior of the container. However, the problem has been found to be reliably avoided by the present invention, since the presence of the two coolers 47, 48 ensures that the contents of the container are cooled from almost all sides.

Figure 3:
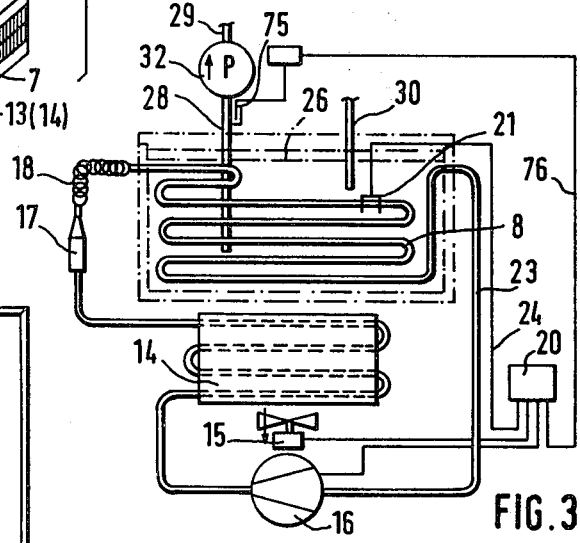
FIG. 3 is a diagram illustrating the fluid and electric circuits of the system shown in FIG. 2.

The coolers 47, 48 receive cooling liquid from a suitable source such as, for example, the "ice water" system illustrated in FIGS. 2 and 3.

The system of FIG. 2 has a water container which is generally designated by the reference character 1 and has an open top which can be closed by the illustrated cover 2. The sidewalls of the container are denoted by the characters 3, 4 and 5 and its bottom wall by the reference character 7. All walls, as well as the cover 2, are thermally insulating, either by being made of thermally insulating material or by having thermally insulating material (e.g., synthetic plastic foam) inserted or embedded therein. The interior of the container 1 is clad with a waterproof lining or coating, as is the cover 2.

An evaporator coil—preferably of copper—is denoted by the reference character 8 and is mounted within the container 1 so as to be spaced from the sidewalls 3–5 thereof. The coil 8 is the evaporator coil of a cooling compressor, the remaining parts of which are preferably housed in a base 13 on which the container 1 is supported. The perimeter of the base 13 is surrounded by a sheet metal member which is apertured to permit the circulation of air (apertures not shown) and which carries a plurality of conduit windings 14 which constitute the condenser of the system. An air impeller 15 (FIG. 3) is located within the base 13 and in operation forces a stream of air to circulate through the base and to pass around the condenser 14. The reference character 16 denotes the compressor itself; the reference character 17 denotes a drier; and the reference character 18 denotes a capillary tube which connects the drier 17 with the evaporator 8.

A control device 20 (e.g., a conventional electronic switch) receives signals from a so-called icebank sensor 21 mounted on the evaporator 8. When the sensor 21 indicates that the coating of ice ("icebank") on the evaporator 8 has reached a certain (preselected) thickness, the device 20 arrests the impeller 15 and the compressor 16 until a follow-up signal from sensor 21 indicates that the thickness of ice has dropped below a certain (again preselected) value.

A comparison of FIGS. 2 and 3 indicates that all parts of the cooling system are installed in the base 13, with the exception of the evaporator 8 and sensor 21. The capillary tube 18, as well as a conduit 23 connecting the evaporator 8 with the compressor 16 and a conductor 24 connecting the sensor 21 with the control device 20, are so routed that they can be accommodated in a watertight tube 25 which extends through the bottom wall 7 (in which it is watertightly secured) and upwardly in the container 1 to a level above the highest permissible filling level 26 (see the broken line in FIG. 2) for water in the interior 27 of container 1.

A rotary pump 32 is mounted at the upper (outer) side of the cover 2 and its suction side is connected to a suction conduit 28 which extends downwardly through the cover 2 and into the interior 27 of the container 1. The pressure side of the pump 32 is connected to a conduit (or a nipple) 29 which, in turn, is connected to the inlet pipe 45 (compare FIG. 1). A return conduit (or nipple) 30 is mounted on the cover 2 and extends therethrough to communicate with the interior 27 of the container 1; the conduit 30 is connected to the outlet pipe 46 (compare FIG. 1) so that an endless path is completed through it.

In operation of the device, the interior 27 of the container 1 is filled with water up to the level 26 and the described refrigeration system is started. The water in the container 1 is thus cooled; when it reaches a temperature of 0° C., banks or layers of ice will form on the convolutions of the evaporator coil 8. It is this ice which affords a "cooling reserve", i.e., which ensures that the water in container 1 will always be maintained at 0° C. ("ice water"). When the thickness of the ice has increased to a sufficient extent (which can be determined by calculation or empirically), the sensor 21 transmits to the device 20 an appropriate signal which causes device 20 to arrest the impeller 15 and the compressor 16 and to start up again only when another signal from the sensor 21 indicates that the thickness of the ice layer has dropped below a predetermined minimum.

A thermal sensor 75 (known per se) is mounted on the suction conduit 28 to sense the temperature of water flowing therethrough. It is connected with the device 20 via conductor 76 and controls the device 20 in a manner similar to the control exercised by the sensor 21, but in this case in dependence upon the temperature of water flowing in the conduit 28. This control possibility is an alternative to the sensor 21, i.e., one or the other of the sensors 21, 75 can be disconnected (e.g., at the control device 20) depending upon which parameter (ice thickness or water temperature) is desired to be used as the control factor. The device 20 may be so constructed that the operator can select the temperature at which a signal from the sensor 75 triggers the operation of the device 20.

Figure 5:
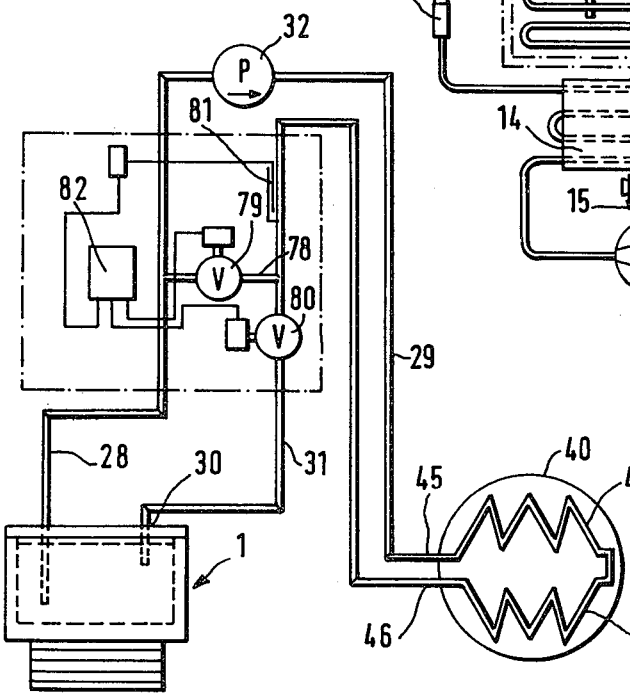
FIG. 5 is a diagram analogous to that of FIG. 3, but illustrating the fluid and electric circuits in conjunction with a bypass control.

The refrigeration system of FIG. 5 can be used in the arrangement of FIG. 2 as an alternative to the system shown in FIG. 3 and the thus modified arrangement can be used in conjunction with the embodiment of FIG. 1. Elements which are the same as, or clearly analogous to, elements shown in FIGS. 2 and 3 are denoted in FIG. 5 by the same reference numerals as before.

The arrangement of FIG. 5 is quite similar to that of FIGS. 2 and 3 but includes a bypass control which is shown within the chain-line box for easier identification. This includes a branch conduit 78 connecting the suction conduit 28 with a conduit 31 which leads from the outlet pipe 46 to the return flow pipe 30. Interposed in this branch conduit, to permit it to be blocked, is a valve 79. Downstream of the connection with the branch conduit 78 the conduit 31 has interposed in it a further blocking valve 80 and upstream of this connection with branch conduit 78 it is provided with a thermal sensor 81.

The valves 79, 80 are connected to a control device 82 which responds to signals from the thermal sensor 81. The valve 79 in conduit 78 is normally closed and the valve 80 in the conduit 31 normally open. If the sensor 81 determines that water flowing in the return flow conduit 31 has a temperature which is lower than a preselected temperature, the signal which it furnishes to the device 82 causes the device 82 to open the valve 79 and close the valve 80; these settings are reversed only when the sensor 81 determines that the water in the return flow conduit 31 has again reached a temperature at or above the preselected temperature level.

The invention is susceptible of various modifications. For example, the tank and the insulating shells for it need not be spherical. As shown in FIG. 4, it would be possible to use a tank 89 which has a cylindrical shape and is composed of two shell sections 84, 85 meeting in a parting plane 88 in which the central longitudinal axis 86 of the tank is located. The sections 84, 85 are appropriately connected with one another to make the tank fluidtight and pressure resistant, if the latter feature is required. The tank 89 is thermally insulated by means of an insulating jacket 87 which is also composed of two shells meeting in the plane 88. In all other respects, the arrangement of FIG. 4 is identical to that of FIG. 1.

Without further analysis, the foregoing will so fully reveal the gist of the present invention that others can, by applying current knowledge, readily adapt it for various applications, without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the claims.

We claim:

1. In a cooling device for fluids, particularly beverages, the combination comprising:

(a) a vessel for accommodating a body of fluid, said vessel having an upper portion and a lower portion;

(b) fluid inlet and outlet means for admitting fluid into and withdrawing fluid from said vessel;

(c) a thermally insulating jacket closely surrounding said vessel;

(d) cooling means for said vessel intermediate the latter and said jacket and overlapping a substantial part of the surface area of said vessel, said cooling means having an upper cooling section which contacts said upper portion and a lower cooling section which contacts said lower portion, and said cooling means having an inlet and an outlet and being arranged for flow of a cooling fluid therethrough from said inlet to said outlet; and (e) supply means for passing a cooling fluid through said cooling means, said supply means comprising:

(1) a base;

(2) a thermally insulated water container supported by said base; and (3) a refrigeration system, the prominent parts of which are contained within said base, said refrigeration system including an evaporator located within and in heat exchanging relationship with the interior of the container, first conduit means including pump means connecting the water container with the inlet and the outlet, and second conduit means connecting the prominent parts of the refrigeration system with the evaporator, said second conduit means having portions which extend through a wall of said container to a height exceeding the maximum permissible filling level of the latter and further comprising a pipe which surrounds said conduit portions, said pipe being substantially watertight in said container and extending through said wall in substantially watertight relationship.

2. The combination of claim 1, wherein said wall is a bottom wall of said container.

* * * * *